United States Patent [19]

Gianfranco

[11] 4,218,017

[45] Aug. 19, 1980

[54] OSCILLABLE SPRINKLER FOR CULTIVATED PLOTS, SUCH AS FIELDS, MEADOWS, GARDENS AND THE LIKE

[75] Inventor: Roman Gianfranco, Pasiano, Italy

[73] Assignee: Claber S.p.A., Fiume Veneto, Italy

[21] Appl. No.: 944,138

[22] Filed: Sep. 20, 1978

[51] Int. Cl.[2] ..... B05B 3/16

[52] U.S. Cl. ..... 239/242

[58] Field of Search ..... 239/240, 242, 236, 255; 74/53

[56] References Cited

U.S. PATENT DOCUMENTS

| | | | |
|---|---|---|---|
| 1,696,385 | 12/1928 | Coles | 239/242 |
| 2,621,967 | 12/1952 | Sorensen | 239/242 |
| 3,063,646 | 11/1962 | Ballard | 239/242 |
| 3,261,553 | 7/1966 | Kool et al. | 239/242 |

FOREIGN PATENT DOCUMENTS

| | | | |
|---|---|---|---|
| 752268 | 2/1967 | Canada | 239/242 |

*Primary Examiner*—Robert W. Saifer

*Attorney, Agent, or Firm*—Cushman, Darby & Cushman

[57] ABSTRACT

For overcoming the dead centers of the motion of an oscillable sprinkler of the kind used for watering "greens", gardens and the like, in which the swing of the sprinkling arm is determined by the water itself, an oval cam mechanism is provided which can also limitedly adjusted as to its angular phase. A more uniform watering density can be obtained the whole watered plot throughout.

2 Claims, 4 Drawing Figures

OSCILLABLE SPRINKLER FOR CULTIVATED PLOTS, SUCH AS FIELDS, MEADOWS, GARDENS AND THE LIKE

This invention relates to an oscillable sprinkler for cultivated plots, such as fields, meadows, gardens and the like.

Oscillable sprinklers are known, which operate on the basis of the adoption of an oscillable arm of tubular form, in the interior of which water is fed for being sprinkled and emerges in indivudal jets through a plurality of radial holes distributed along the length of the oscillable arm. Usually, the watering liquid itself, prior to reaching the oscillable arm, produces, with the intermediary of an appropriate rotor, the continuous rotation of a driving shaft from which a drive transfer mechanism of the crank and connecting rod type usually takes its drive for the reciprocal oscillatory motion of the sprinkling arm.

The conventional sprinkling devices have the defect that they do not furnish an even distribution of the water on the entire surface to be watered. It has been experimentally ascertained, in fact, that the density of water which has fallen at the extreme boundaries of the wetted surface is somewhat higher than that experienced on the remaining surface. As it is apparent, this was the results of the inevitable slow-downs and stopping times of the swinging arm in correspondence with the dead centers of the reciprocal swinging motion.

An object of this invention is to provide an oscillable sprinkler of the kind referred to above, which, by the adoption of appropriate expedients, is capable of carrying out a substantially even distribution of watering liquid on the entire watered surface, more particularly preventing an excessive precipitation of water in correspondence of the extreme boundaries of the watered surface.

According to the invention, such as object is achieved by means of an oscillable sprinkler which comprises a swinging tubular arm closed at one end and having a plurality of radial holes distributed along the arm end, means for feeding watering liquor to the interior of the oscillable arm through the other end thereof, a driving shaft rotatable continuously about its own axis and a crank and connecting rod assembly for connecting said driving shaft to said oscillable arm for converting the continuous rotary motion of the former into a reciprocal swinging motion of the latter, said assembly having the crank affixed to the oscillable arm and the connecting rod arranged with either end pivoted to said crank and its other end linkably connected to the drive shaft, characterized in that said other end of the connecting rod is pivoted to a cam follower inserted for sliding in a guiding member radially formed on a disc carried by said drive shaft and rotated thereby, said cam follower being engaged with a fixed cam having a substantially oval outline arranged coaxially with the drive shaft and so keyed that the engagement of the follower with the ends of the cam substantially corresponds to the arrival of the swinging arm at the dead centers of its reciprocal swinging motion.

As can easily be understood, the substantially oval outline of the cam is responsible, in association with the sliding engagement existing between the cam follower and the disc which is integral with the driving shaft, for avoiding the above enumerated shortcomings of the conventional oscillable sprinklers. The arrival of the follower of the cam in correspondence with the cam ends originates, in fact, a ridial displacement of the follower away of the driving shaft and the result is a corresponding increase of the follower velocity and, thus, with the intermediary of the crank and connecting rod assembly, the velocity of the swinging arm is also increased. In correspondence with the dead centers, the oscillable arm thus receives an accelerating pulse which permits that the transition times through the dead centers may be reduced and thus that the quantity of water sprayed at the extreme boundaries of the watered area be also reduced. Consistently, inasmuch as the accelerations determined by the cam ends are obviously accompanied by corresponding slowdowns originated by the intermediate cam regions which are nearer to the drive shaft, the quantity of water distributed at the center of the watered surface is increased, on the other hand, so that a substantially even distribution of water is achieved the whole surface being watered throughout.

The foregoing and other features of the present invention will become fully apparent from the ensuing description of an exemplary practical embodiment thereof as shown in the accompanying picture and drawings, wherein.

Figure 1:
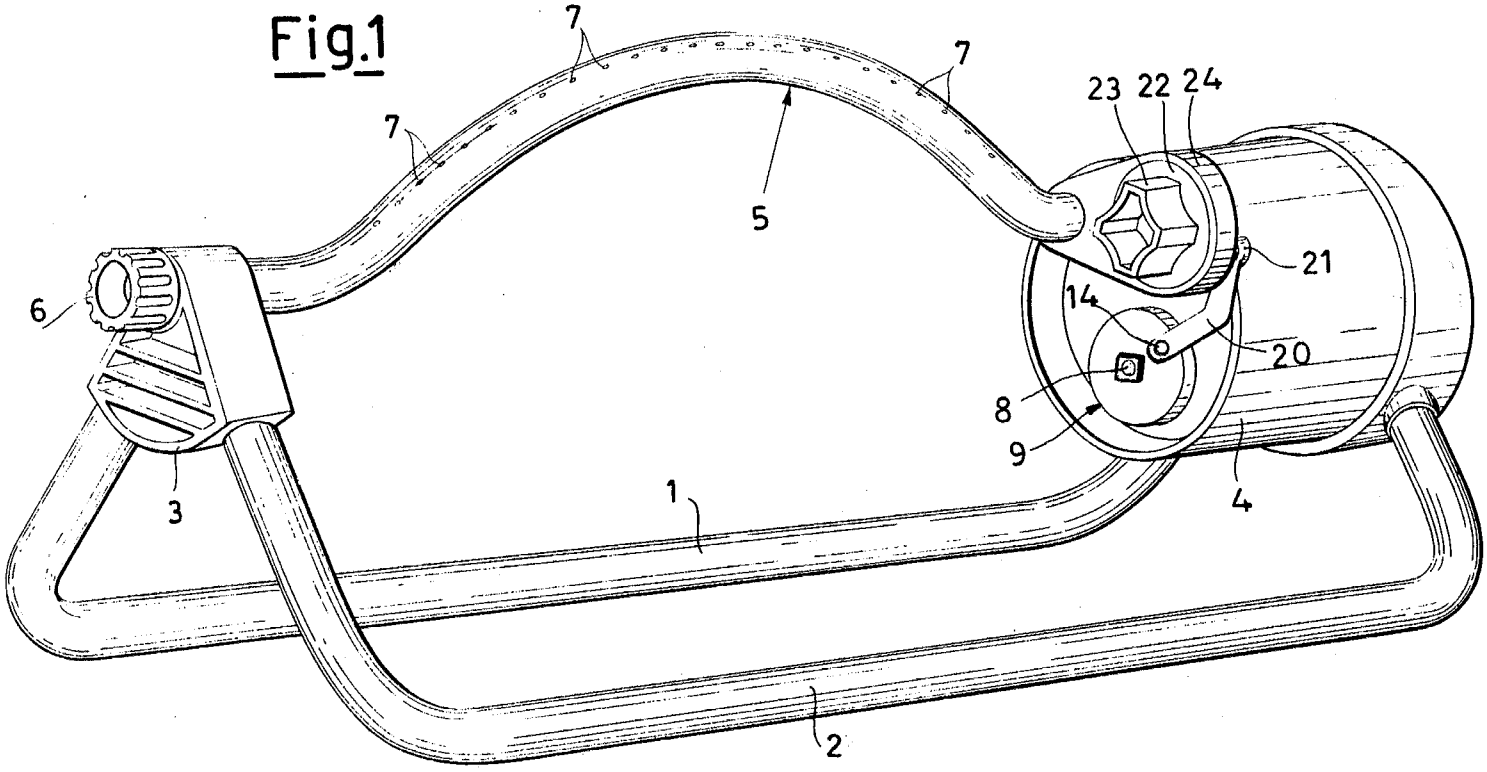
FIG. 1 is a perspective view of an oscillable sprinkler according to the present invention.

The oscillable sprinkler in the example shown comprises a supporting structure formed by two metal tubular members bent in U shape, 1 and 2, which are sloping the one towards the other and support with their coinciding ends an inverted-V stand 3 and an actuating and supporting box 4.

The stand 3 and the box 4 support for rotation a tubular oscillable arm 5 which has either end closed by a plug 6 and has a plurality of radial holes regularly formed with an appropriate angle, 7, which are the nozzles for spraying the watering liquid.

Water is fed to the sprinkler in correspondence with a mouth placed in the rear of the box 4 (thus it cannot be seen in the drawings) and through the box, in a manner known per se, and is then caused to reach the other end of the oscillable arm and thus fed to the interior of the latter.

Still in conventional manner, more particularly by means of an appropriate rotor and drive transferring gears housed in the box 4, the watering liquor also provides to impress a continuous rotary drive to a driving shaft 8 which is borne for rotation within the same box 4.

Figure 2:
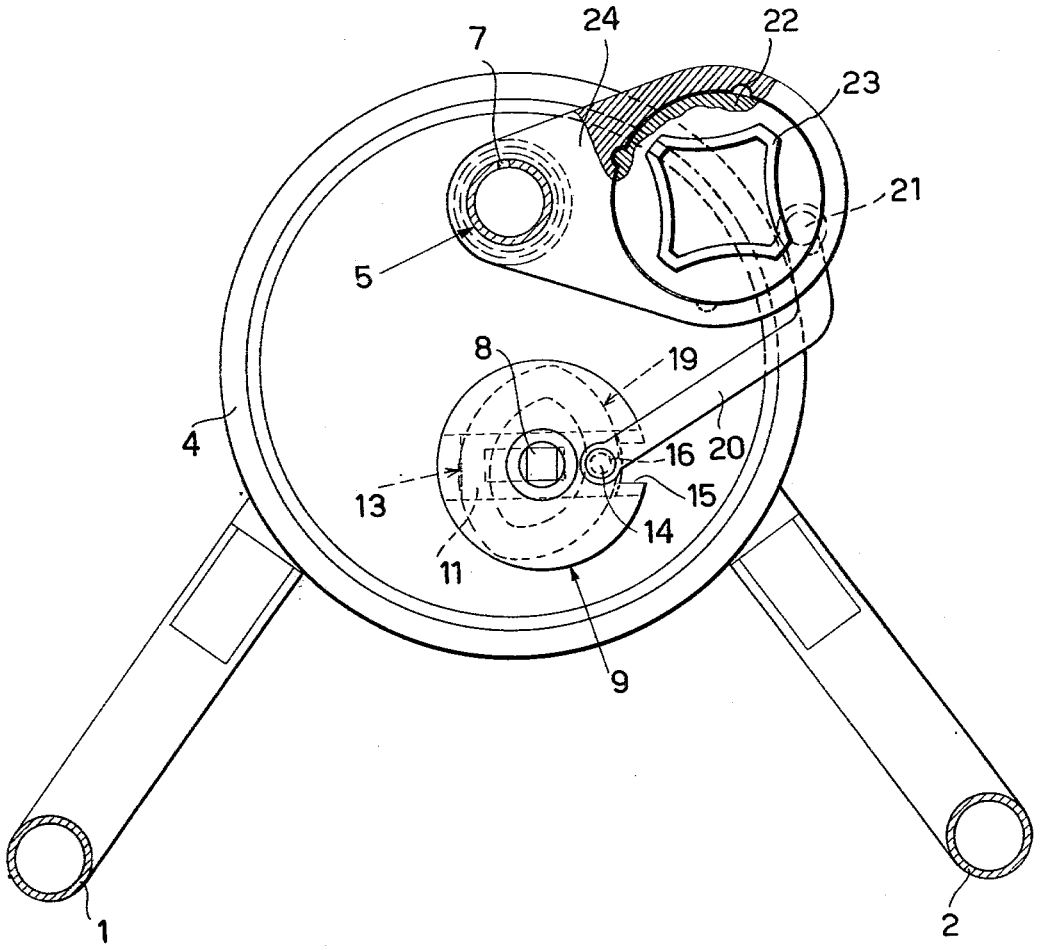
FIG. 2 shows the same sprinkler in cross-sectional view taken near the feeding end for the watering liquid.
Figure 3:
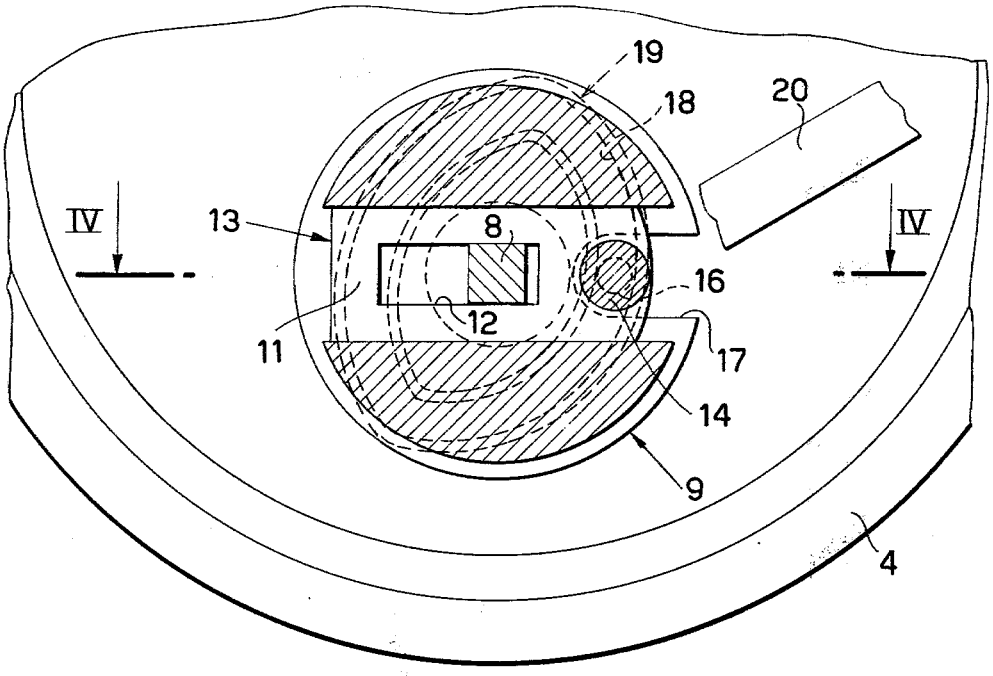
FIG. 3 is a closeup view of the drive-transfer unit of the sprinkler, the cross-section being taken along the line III—III of FIG. 4.
Figure 4:
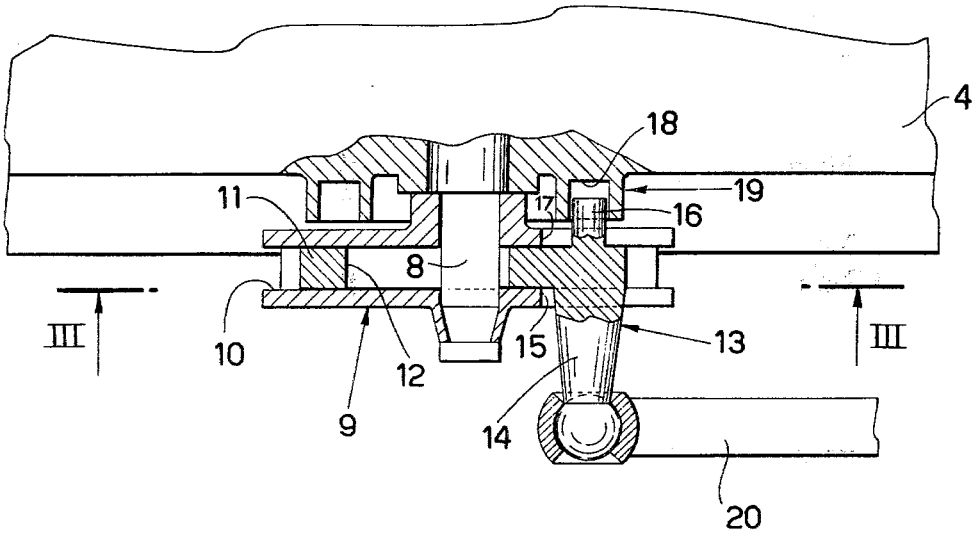
FIG. 4 shows the closeup view of FIG. 3 but the cross-section has been taken along the line IV—IV of FIG. 3.

To the drive shaft 8 is also keyed a disc 9 (FIGS. 2, 3, 4) which has formed diametrically therethrough an inner passageway 10, in which is housed and guided for sliding a rectangular plate 11 having a rectangular slot 12 for allowing the drive shaft 8 to pass therethrough (FIGS. 3 and 4). The plate 11 is a portion of a cam follower 13 which, as shown in FIG. 4, also comprises a spherical-head plunger 14 housed and guided for sliding in a first radial groove 15 of the disc 9 and a dog 16 passed through a second radial slot 17 (superposed to 15) of the disc 9 and slidingly engaging an internal throat 18 of a cam 19 fastened to the box 4 coaxially with the drive shaft 8. As shown in FIGS. 2 and 3, the cam 19, or better to speak its throat 18, has a substantially oval outline with the two ends slightly shifted angularly relative to a vertical plane passing through the axis of the drive shaft 8.

To the spherical head of the plunger 14 of the cam follower 13 is universally pivoted a first end of a bell-crank lever 20, the second end of which is universally pivoted to a stud 21 jutting from a disc 22: the latter has a manipulating lever 23 (FIG. 2). The disc 22 is borne for rotation by a supporting member 24 fastened overhangingly on the swinging arm 5, conventional means being properly inserted between the disc and the supporting member for allowing the disc to be held, occasionally, in one optional position among the plurality of angular positions selectable by the manipulating lever 23.

By virtue of the structure described hereinbefore the oscillable sprinkler shown in the picture and the drawings operates as follows.

As the water is continuously fed to the oscillable arm 5 and ejected therethrough through the nozzles 7 in the form of individual jet sprays, the water itself impresses a continuous rotary motion to the drive shaft 8: the latter entrains in its rotation the disc 9 and the cam follower 13 and causes through the connecting rod 20 and the crank (constituted by the disc 12 and the supporting member 24) a consequential reciprocal rotation of the swinging arm 5 about the axis defined by the end supporting members 3 and 4. Since the cam follower has its dog 16 in engagement with the oval track 18 of the cam 19, the constant speed of rotation of the drive shaft 8 is converted into a velocity of rotation of the plunger 14 which is not constant but is increased near the ends or poles of the cam 19. The result is that the reciprocal rotation of the swinging arm 15 receives an acceleration pulse whenever the dog 16 of the cam follower 13 engages one end of the cam 19, that is, on account of the angular orientation of the latter, in the correspondence of the dead centers of the reciprocal swinging motion. Such an acceleration reduces the times of stay of the swinging arm in correspondance of the dead centers or near them, the beneficial result being a more uniform distribution of the sprayed water the entire watered surface throughout. The position of the dead centers, which in any case corresponds to the attainment of the engagement of the cam followers with the ends of the cam 19, can partially be modified by varying, by the manipulating lever 23, the angular position of the disc 22 relative to the supporting member 24.

I claim:

1. An oscillable sprinkler for cultivated plots such as fields, meadows, gardens, comprising a tubular oscillable arm closed at one end and having a plurality of radial holes distributed along its length, means for feeding water to the interior of said oscillable arm through the other end thereof, a drive shaft rotated continuously about its axis and a crank-and-connecting-rod assembly arranged for connecting said drive shaft to said oscillable arm for converting the continuous rotary motion of said shaft into a reciprocal swinging motion of the arm, said assembly having the crank fastened to the oscillable arm and the connecting rod arranged with said one end pivoted to said crank and the other end likably connected to the drive shaft, characterized in that said other end of the connecting rod is pivoted to a cam follower inserted slidably in a guide track formed radially on a disc carried by said drive shaft and rotated in unison therewith, said cam follower being engaged by a fixed cam having a substantially oval profile arranged coaxially with said drive shaft and so oriented that the engagement of the follower with the cam ends substantially corresponds to the arrival of the swinging arm at the dead centers of its reciprocal swinging motion.

2. An oscillable sprinkler according to claim 1, characterized in that said crank comprises a supporting member overhangingly affixed to the swinging arm and a disc with a connecting-rod pivotal pin carried by said supporting member, means being provided for varying between predetermined stable positions the angular orientation of said disc relatively to said supporting member.

* * * * *

UNITED STATES PATENT AND TRADEMARK OFFICE

CERTIFICATE OF CORRECTION

PATENT NO. : 4,218,017

DATED : August 19, 1980

INVENTOR(S) : Gianfranco Roman

It is certified that error appears in the above—identified patent and that said Letters Patent is hereby corrected as shown below:

At paragraph [75] on the front page format the inventor's name should read --Gianfranco Roman--.

Signed and Sealed this

*Seventh* Day of *April 1981*

[SEAL]

*Attest:*

RENE D. TEGTMEYER

*Attesting Officer*

*Acting Commissioner of Patents and Trademarks*